US006062210A

United States Patent [19]

Welles

[11] Patent Number: 6,062,210

[45] Date of Patent: May 16, 2000

[54] PORTABLE HEAT GENERATING DEVICE

[75] Inventor: Clifford G. Welles, P.O. Box 166, Pleasanton, Calif. 94566

[73] Assignee: Clifford G. Welles, Pleasanton, Calif.

[21] Appl. No.: 09/018,769

[22] Filed: Feb. 4, 1998

[51] Int. Cl.[7] ..... A61F 7/00; F24J 1/00

[52] U.S. Cl. ..... 126/208; 126/263.01; 126/263.07; 431/268; 431/7

[58] Field of Search ..... 126/263.01, 208, 126/206, 204, 263.02, 263.07; 431/7, 268, 356

[56] References Cited

U.S. PATENT DOCUMENTS

| | | | |
|---|---|---|---|
| 1,347,631 | 7/1920 | Herck | 431/258 |
| 1,792,337 | 2/1931 | Wallin | 122/236 X |
| 2,005,477 | 6/1935 | Schmitt | 431/147 |
| 2,384,852 | 9/1945 | Schmitt | 431/268 |
| 2,764,969 | 10/1956 | Weiss | 126/208 |
| 2,855,758 | 10/1958 | Johnson | 62/4 |
| 3,029,802 | 4/1962 | Webster | 126/93 |
| 3,191,659 | 6/1965 | Weiss | 431/328 |
| 3,198,240 | 8/1965 | Keith | 431/329 |
| 3,295,594 | 1/1967 | Hopper | 165/46 |
| 3,688,762 | 9/1972 | Chi et al. | 126/204 |
| 4,016,878 | 4/1977 | Castel | 128/212 |
| 4,140,247 | 2/1979 | Rice | 222/146.3 |
| 4,235,588 | 11/1980 | Tanaka | 431/147 |
| 4,334,519 | 6/1982 | Cieslak | 126/204 |
| 4,516,564 | 5/1985 | Koiso | 126/263.02 |
| 4,522,190 | 6/1985 | Kuhn | 126/263.02 |
| 4,662,352 | 5/1987 | Aviles | 126/204 |
| 4,685,442 | 8/1987 | Cieslak | 126/204 |
| 4,756,299 | 7/1988 | Podella | 126/263.02 |
| 4,894,931 | 1/1990 | Senee | 36/2.6 |
| 4,995,126 | 2/1991 | Matsuda | 5/421 |
| 5,125,392 | 6/1992 | Hardwick | 126/263.02 |
| 5,275,156 | 1/1994 | Milligan | 607/114 |
| 5,282,740 | 2/1994 | Okayasu | 431/344 |
| 5,425,975 | 6/1995 | Koiso | 428/74 |

*Primary Examiner*—Larry Jones

[57] ABSTRACT

A portable heat generating device in which fuel vapor and an oxygen supply (e.g. air) are directed through channels contained within a thin, flexible and compliant elastomeric sheet of material. Elongated catalytic heat elements, placed strategically within the channels, spontaneously interact with the fuel-air stream liberating heat energy. Means and methods are defined that permit flameless catalytic combustion to be uniformly extended over the length of each heat element, lowering power density but maintaining the overall power generated, permitting the use of many types of low temperature materials like plastics, polymers, and elastomers in the construction of the heater. The heat generation process is started by pumping an air stream into a reservoir containing a fuel source (e.g. methanol) thereby saturating the air stream with fuel vapor. The fuel vapor is mixed with a another stream of air to achieve a particular fuel/air ratio and directed into channels within the elastomeric sheet, reacting with the catalytic heat elements to produce flameless combustion. The warm exhaust gas is directed to a thermally controlled diverter valve. The valve senses the temperature of the liquid fuel supply and diverts some or all of the warm exhaust gas, as necessary, to heat the fuel and keep its temperature within a specified range. Exhaust by-products are passed into a miniature scrubber module adjacent to the fuel module. The scrubber absorbs any noxious components in the exhaust stream that may occur during start-up or rapid changes in operating condition.

20 Claims, 7 Drawing Sheets

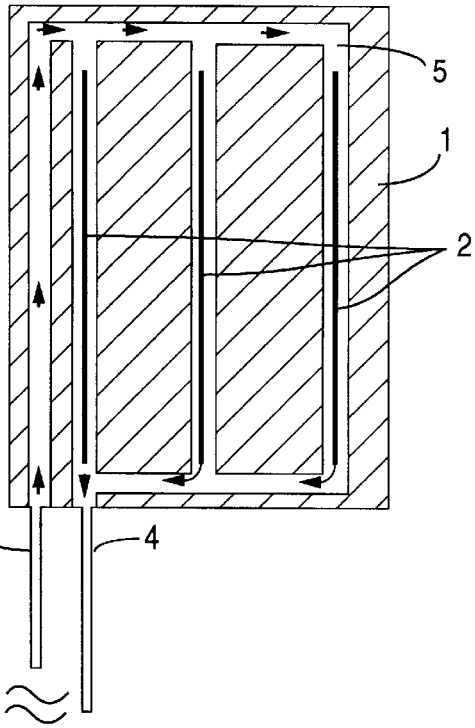
FIG. 1
FIG. 2
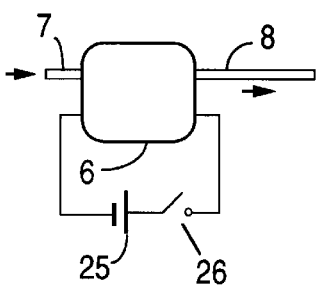
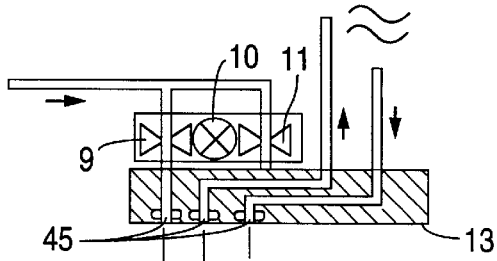
FIG. 3
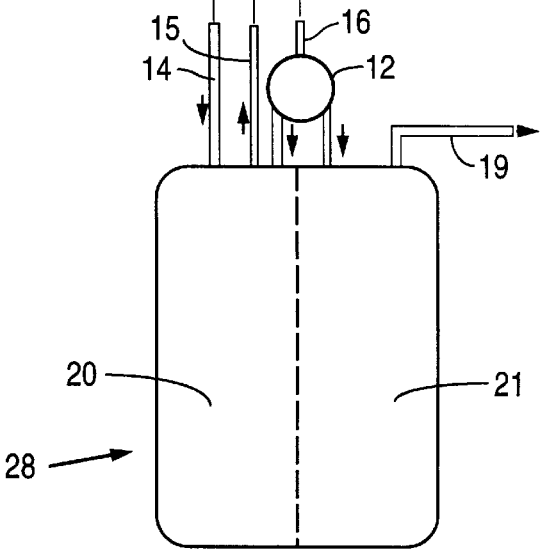
FIG. 4

1
2
9
9
29
30
31
32
31
33
34
35
31
46

PORTABLE HEAT GENERATING DEVICE

CROSS REFERENCE TO RELATED APPLICATIONS

This application is a continuation-in-part of application Ser. No. 08/763,603 filed on Dec. 11, 1996, now allowed.

BACKGROUND OF THE INVENTION

1. Field of the Invention

The present invention generally relates to a portable device for regulated production of heat by catalytic reaction, and more particularly to a portable heat generating device in which heat is uniformly generated across the surface of a thin sheet-shaped, elastomeric structure.

2. Description of the Prior Art

A variety of portable chemical heat generating devices are known which can be incorporated into, for example, outerwear, garments and blankets.

A first type of device is taught in U.S. Pat. No. 4,516,564 and U.S. Pat. No. 4,756,299. This first type of device includes a powdered, exothermic material, such as oxidizable metal, which is maintained in a sheet-like form and covered with a porous, air permeable sheet. The amount of air permeating the sheet is regulated to control the reaction rate of the exothermic materials, thereby controlling the amount of generated heat.

A second device is taught in U.S. Pat. No. 5,425,975. In this second device, exothermic material is dispersed in and supported by a sheet-like substrate made up of a plurality of irregularly arranged fibers having a multiplicity of gaps there between which facilitate air flow to the exothermic material. The sheet-like substrate is held in a bag having air-permeation holes. As with the first type of device, the amount of air entering the sheet-like substrate passing through the gaps is controlled such that the exothermic material generates a desired amount of heat. A third device is taught in U.S. Pat. No. 5,125,392. In this device, exothermic material is held within a multitude of holes formed in a thermogenic material mat located between a pair of panels. Air is supplied to the exothermic material by a pump through a first plurality of air passages, and exhaust gases exit though a second plurality of air passages. The amount of heat generated by the exothermic material is controlled by controlling the air flow through the pump.

A problem associated with the above-mentioned first, second and third known device types is that the exothermic material is depleted after a period of use, thereby terminating the heat generating process. When the exothermic material is depleted, it is necessary to either dispose of some or all of the heating device, or to perform a cumbersome and time consuming process of replacing or regenerating the exothermic material. These characteristics make such devices impractical for multi-day travel on foot in isolated geographic locations where weight, convenience and refuse considerations are important.

Another problem associated with the above-mentioned first and second device types is that heat production is turned on and off relatively slow because it is regulated by means of natural diffusion of air through permeable membranes of large surface area. Further, if these devices are used for warming parts of the body other than the extremities, turning these devices off requires physical removal of the devices from the body and storage in an air tight compartment. Because these heating devices are usually worn under a passive outer garment in these instances, they are not well suited for heat-on-demand applications where it is impractical or inconvenient to remove the outer layers of clothing.

The above-mentioned first and second device types also suffer from the inability to provide a wide range of thermal power output. In order to insure that the devices do not produce unsafe temperature, their maximum thermal power production, even under the best conditions, must by necessity be fixed and limited to a relatively low value. Thus, the potentially high power production of the above chemical heaters are never really made available to the user when the environmental conditions might justify it.

A fourth portable heat generating device is taught in U.S. Pat. No. 4,685,442. This portable heating device generates heat in a heat exchanger with is mounted at a location remote from the desired point of application of the heat. A circulating heat transfer fluid is pumped through the heat exchanger and then delivered to a remote location to perform the warming function. However, because of heat loss from the heat transfer fluid as it travels to the desired point and the intrinsic nature of heat exchange processes in general, the energy efficiency of this device is relatively poor. Furthermore, the device is relatively heavy because, in addition to the fuel required to provide the heat energy, the heat transfer liquid is required to transport the heat to the desired point. Another shortcoming of the fourth device is that the heat transfer fluid retains heat for a significant period of time after extinguishing the heat source because of the high heat capacity of liquids (i.e. as compared to gasses), thus preventing rapid regulation of the heat supply.

A fifth portable heat generating device is taught in U.S. Pat. No. 2,764,969. This device utilizes the flameless combustion principle and methanol based fuel-air mixture, however, it makes no provision for the safe handling of any unburned fuel or products of incomplete combustion. Any catalytic portable heat generating device that is used in close personal contact with the human body or in confined spaces such as a tent, vehicle or small room would be deemed impractical and unsafe if products of incomplete combustion or volatile organic compounds (VOC's) were released to the ambient during the heating process. In addition, the above fifth mentioned device type suggests using ⅞ inch diameter tubing within the garment which is substantially intrusive with regard to use in outerwear. Furthermore, the inner tubing material is made of rigid and semi-rigid metal structures that further reduce the ability to be worn comfortably. Also, the method of combustion used in the fifth mentioned device type generally requires much higher temperatures at the reaction surface (the surface in direct contact with the catalytic material) than the present invention since heat is transferred from the reaction surface to the outer surface indirectly and over a relatively large gap. Furthermore, to avoid dangerous surface temperatures, it would appear that the outer tube diameter (i.e. ⅞ inch) may not be reduced significantly below the diameter specified. In any case, significant reduction in the tubing diameter would likewise limit the total power that can be radiated at safe surface temperatures (e.g. less than 120° F.) because of the small surface area per unit length of the cylindrical geometry, as compared to a sheet like geometry.

Yet another problem with the above mentioned fifth device type is that no provision is made to avoid problems that may occur during portions of the operation cycle when condensation of water vapor (i.e. a combustion by-product) within the tubing may cause self-extinguishment of the combustion process or prevent re-start after shutting off the apparatus. It has been found that a fast heat-up of a catalytic heat element while the channel wall is still cool or a fast cool down of the envelope containing the heat element or a rapid change in operating conditions (e.g. flow rate, fuel/air ratio, ambient temperature, etc.) may cause condensation within the channels. Furthermore, for many applications it is desirable to operate a catalytic heater in the following manner:

(a) Relatively low surface temperature of catalytic heat element; to allow the use of elastomeric plastics as the primary component in construction of the heat sheet.

(b) Low fuel-air flow rates; to minimize air pump size, weight and power requirements.

(c) Relatively high fuel/air ratio; to allow high power levels and system efficiencies when operating at low flow rates.

Each operating constraint listed in items (a) through (c) can exacerbate potential condensation effects and therefore may be problematic unless some remedy is employed. In addition, none of the prior art attempts to optimize all three of the above items (a) through (c).

Prior art catalytic heaters, as taught for instance in U.S. Pat. No. 4,140,247, U.S. Pat. No. 3,191,659, U.S. Pat. No. 3,198,240, and U.S. Pat. No. 5,282,740, typically operate at high reaction surface temperatures with relatively high gas flow rates and generally release their exhaust products immediately to the atmosphere, thus avoiding concern about water condensation interfering with heater operation. In U.S. Pat. No. 4,662,352, the fuel/air ratio is kept low, between 1% to 3% fuel-to-air ratio (by volume), thus avoiding problems with water condensation, as well as, avoiding significant spatial asymmetries in the combustion process (i.e. combustion occurring largely in the vicinity of where the fuel-air stream first contacts the catalytic material). However, this approach would not be efficient if applied to a personal heat device where significant power levels at low power densities and low flow rates are desired.

Yet another problem with prior art catalytic heaters, as inferred in item (a) above, is that the relatively high reaction temperatures require the use of metallic structures and other rigid materials in the construction of the heater, preventing implementation of a substantially all synthetic polymer construction that would allow the device to achieve the optimum tactile, flexible and pliant character required for comfortable and unobtrusive inclusion into outerwear.

All of these shortcomings, as well as, others associated with prior art chemical heat generating devices, limits their applications or area of use. The present invention provides a novel approach to overcome these difficulties and appreciably increase marketability for use in, for example, outerwear, garments, blankets and sleeping bags, and the like.

OBJECT OF THE INVENTION

In view of these and other problems in the prior art, it is a general object of the present invention to provide an improved apparatus and method for constructing a portable heat generating device in which fuel vapor (e.g. methanol) and an oxygen supply (e.g. air) is delivered throughout channels formed within a sheet-shaped elastomeric structure.

Another object of the invention is to provide a catalyst that promotes spontaneous flameless combustion of the fuel vapor and oxygen, eliminating the necessity for regenerating or disposing of spent powdered exothermic material.

A further object of the invention is to release heat, substantially uniformly, along the length of specially constructed catalytic heating elements operating at relatively low reaction temperatures (for example, between 120° F. and 350° F.) so as to allow very thin elastomeric heat sheet construction (for example, between 1 to 4 millimeters); thus making it possible to eliminate the use of rigid hard structures in constructing the heat sheet.

Still another object of the present invention is to provide a portable catalytic heating system that is light in weight, thin in profile, unobtrusive and comfortable when incorporated into articles of personal wear, such as; outerwear, garments, boots, gloves, blankets, as well as, cold weather gear used by the outdoor enthusiast like parkas, sleeping bags, ground pads and the like, while being practical for extended use in wilderness environments.

Another object of the invention, is to eliminate the need for circulating a heat transfer liquid with its consequent energy inefficiency, extra weight and bulk by directing a heat generating gas (fuel-air vapor) to the site where heat is desired.

Yet another object of the invention is to combine the benefits of a relatively low surface temperature catalytic heat element, with the benefits of low flow rate and high fuel/air ratios (e.g. 10% to 20% or more fuel/air ratio by volume), while simultaneously avoiding water condensation effects that can interfere with or extinguish the heat reaction. The present invention utilizes a novel approach by surrounding the catalytic heat generating material with a micro-porous hydrophobic membrane. These micro-porous membranes allow the fuel-air vapor to enter and react while letting the combustion products (i.e. $CO_2$, $H_2O$ vapor) escape. At the same time, condensed water vapor, which may happen during start-up, rapid changes in the environment or when operating below the critical vapor curve for whatever reason, is prevented from entering the micro-porous material and coming in contact with the catalyst.

Still another object of the invention is to avoid combustion zone contraction when operating in a condition of relatively low volume flow rates with high fuel/air ratios. The region of flameless combustion is extended substantially over the whole length of the catalytic heat element allowing a relatively low power density (e.g. approximately 1 to 2 watt per inch or less) for the heat element. In this manner, a plurality of catalytic heat elements can be distributed within an elastomeric sheet so as to cover a large area, such that the total power dissipated is still substantial and the surface temperature of the heat sheet is within a safe range under conditions of human skin contact or near contact.

A still further object of the present invention is to provide a catalytic heater of the character described wherein the exhaust flow from the catalytic heat element is directed to a gas scrubber cell and rendered free of volatile organic compounds before releasing to the environment, and hence, it is safe to use the heater in confined spaces and in close proximity with the human body.

Another object of the invention is to provide a catalytic heater of the character described wherein the exhaust flow from the catalytic heat element is used to raise the fuel temperature in order to maintain a relatively high saturated vapor pressure, hence increasing the chemical energy in a volume of saturated fuel-air vapor, further increasing the efficiency of the system.

A further object of the invention is to regulate a predetermined fuel temperature by means of a thermally controlled diverter valve that apportions the warm exhaust stream between the fuel chamber and scrubber cell according to the liquid fuel temperature in the fuel chamber.

Another object of the invention is to provide a portable catalytic heater of the character described wherein a vapor exchange unit within the fuel chamber provides a ready supply of methanol vapor or other suitable fuel vapor to the carrier gas, supplied by an air source, for example, an electric air pump, and hence allows the fuel chamber to be used in any spatial orientation, micro-gravity or weightless condition without cutting off the fuel vapor flow or risk of spillage or leakage of the fuel supply.

Further objects and advantages of my invention will become apparent from a consideration of the drawings and ensuing description.

SUMMARY OF THE INVENTION

According to the present invention, bringing about a substantially uniform flameless combustion reaction over a long, narrow length of a catalytically active structure, using a single fuel-air feed arrangement, where fuel-air enters at one end of the heat element and exits at the other end, requires the implementation of particular design methods disclosed herein. A surprising result is obtained such that when the average axial thermal conductivity of the heat element is significantly increased, the apparent combustion zone extends out along the length of the element, lowering the power density (e.g. watts per inch) but maintaining the overall power generated. This is true under a wide range of flow conditions and fuel/air ratios. An apparent axial dilation of the combustion zone may also be induced by spatial modulation of the catalytic activity along the length of the heat element. For instance, by having the catalytic activity start off as a low value at the fuel-air entrance and increase toward the opposite end, a heat element that has a normally compressed combustion zone (i.e. one where the temperature profile has a large peak near the fuel-air entrance) can be made to expand along the axis of the heat element such that the peak temperature is near the center of the heat element. The two techniques may also be combined to achieve an optimum blend in performance of the heat elements with a variety of temperature profiles and reactivities.

Thus, because of the lower power density achieved by applying the methods described herein, it becomes practical to fabricate catalytic heaters from plastics and elastomers in the form of flexible, pliant and very thin sheets (e.g. 1 to 4 millimeters) that conform to the human body and are unobtrusive and unnoticeable to the user when worn under a garment. The heat sheet structure is constructed with a plurality of flow channels formed within it. The channels direct the flow of fuel-air vapor throughout the body of the heat sheet. Catalytic heating elements are placed strategically in the channels such that a spontaneous flameless combustion reaction occurs on contact with the fuel-air vapor, liberating heat, which is conducted throughout the body of the sheet-like structure.

The thermal resistance and heat diffusion characteristics of elastomers can be engineered to allow a safe surface temperature (for example 120° F.) across the sheet surface, with a sheet thickness of only 2 or 3 millimeters, even though the channel wall temperature within the heat sheet may be 200° F. or more. (The sheet surface is defined as the portion of the heat sheet that can come in contact with the skin and is distinguished from the catalytic heat element surface which is located within the heat sheet). The freedom to arrange flow channels within the body of the elastomer heat sheet in almost any manner provides improved precision in controlling the heat sheet surface temperature because each heat element may be tailored to achieve specific thermal output and placed throughout the heat sheet so that any particular surface temperature profile across the sheet may be obtained.

A large variety of elastomeric materials are available from which the heat sheet may be constructed depending on the application. This includes but is not limited to; polyurethane RTV, polyurethane closed cell foam, silicone or silicone closed cell foam, polyethylene or polyethylene closed cell foam, polypropylene or polypropylene closed cell foam and polyolefin or polyolefin closed cell foam.

In one embodiment, the catalytic heat elements are long, thin structures, consisting of very flexible, hollow core micro-porous PTFE tubing. The core of the tube contains a reaction promoting catalyst, such as platinum, that reacts spontaneously upon contact with a fuel-air vapor. Each end of the tube is sealed with an epoxy plug. The outer surface of the PTFE tube is then attached to a high thermal conductivity strip of material, as for example, but not limited to; aluminum foil, copper foil or an articulated micro-link metal structure such as used in fine jewelry chains, in order to increase the axial thermal conductivity. The micro-porous membrane is an important component of the heat element in that it allows the fuel-air to reach the catalyst and reaction products to escape while preventing condensed water vapor in the channels from extinguishing or dimishing the reaction.

It should be noted that multiple feeds to a single heat element or multiple feeds to multiple heat elements are considered as a subset of the behavior delineated herein for a single feed since each sub-section can be optimized by applying the techniques described here.

In a particular embodiment, the heat generation process is started by first switching on a miniature electric air pump. The pump provides a source of air flow to the fuel module containing liquid methanol. (Other fuels, for example, hydrogen, formic acid and ethanol are known from the prior art to also induce spontaneous flameless combustion, although methanol is preferred for its relative safety and complete burn characteristics at the low temperatures encountered in this invention). The air passes through a vapor extraction unit that is immersed in the liquid methanol within the fuel chamber. The vapor extraction assembly consists of a thin slab of material, such as polyethylene, with one surface grooved in a continuous serpentine pattern, such that one end of the groove is designated as an input end and the other as an output end. A flat sheet of hydrophobic micro-porous membrane (e.g. such as expanded PTFE) is then placed over the groove and sealed to the polyethylene slab by epoxy such that only the grooved area remains free to act as an air passage through the slab. The whole unit is then placed in the fuel chamber. In operation, the liquid methanol fuel is given an increased surface tension by the addition of about 10% to 15% water. The capillary forces and the hydrophobic nature of the membrane prevent the liquid methanol/water solution from entering the air channels, however, the vapor from the liquid methanol moves through the membrane and into the air channels. The air moving through the air channels picks up and carries the methanol vapor. This simple technique allows operation regardless of fuel chamber orientation and has the additional advantage of a low back pressure.

Upon leaving the vapor extraction unit, the air is saturated with methanol vapor and exits the fuel chamber where the methanol-air stream is diluted with a pure air stream from the air pump. The mixing ratio (i.e. the fuel-to-air ratio) is determined by adjusting the settings on two miniature valves, with one valve controlling the rate of flow into the fuel chamber and the other controlling the dilution process. The valves are coupled together such that only one control knob is needed to determine both the total flow rate into the heat sheet, as well as, the fuel/air ratio. Thus, the rate at which thermal energy is liberated within the heat sheet may be completely regulated by adjusting only one power control knob. This is the primary mechanism for regulating the rate of heat generation within the device. The effect of turning the power control knob may be pre-determinedly varied by appropriate arrangement and dimensioning of the two valves and the coupling between them. Alternatively, the fuel/air ratio may be fixed at some pre-determined level and the flow rate of the air source regulated instead, as for instance by increasing or decreasing the electrical current into the air pump. A combination of both methods provides an even wider range of performance.

After being diluted, the fuel-air mixture is directed through a flexible plastic tube to the heat sheet inlet, where a plurality of channels within the heat sheet direct the fuel-air mixture to flow over a plurality of catalytic heating elements, thereby initiating flameless combustion and heat generation by auto-excitation or spontaneous oxidation. The composition of the flow stream, after reacting with the catalyst, consists primarily of the combustion products $CO_2$ and $H_2O$, with occasional residue of unconsumed methanol vapor that may occur during start-up and rapid changes in operating conditions. The exhaust gas is directed to an exit orifice contained in the heat sheet. A flexible plastic tube, connected to the exit orifice, directs the flow of the exhaust gas back to the fuel module where it enters a thermally controlled diverter valve. The valve senses the fuel temperature within the fuel chamber. If it is above a pre-determined upper set point, the valve sends the warm exhaust stream directly to a scrubber cell that is adjacent but physically isolated from the fuel in the fuel chamber. The scrubber cell preferentially removes any volatile organic compounds (VOC's) that may on occasion be a component of the exhaust stream. The combustion by-products of $CO_2$ and $H_2O$ vapor are released to the atmosphere. A variety of methods are known in the art of gas scrubbers. Activated carbon, which selectively absorbs any unburned methanol, has been found to perform this function adequately, although other approaches such as chemical conversion (e.g. chemically or electrochemically transforming methanol into an compound that is less noxious) also work. The quantity of scrubber material contained in the scrubber cell is in proportion to the quantity of fuel in the fuel chamber. When the fuel is completely used, the fuel module (i.e. combination of fuel chamber and scrubber cell) is removed from the heating device and replaced with a fresh fuel module. In this way, the scrubber cell is always insured of being sufficiently active to guarantee proper purification of the exhaust stream.

When the temperature of the fuel in the fuel chamber drops below a predetermined value, the thermally controlled diverter valve directs some of the warm exhaust gas into a heat exchange device immersed in the fuel. Upon exiting the heat exchange device, the exhaust gas is directed into the adjacent scrubber cell. The warm exhaust gas raises the fuel temperature until a predetermined upper set point is reached, at which time the diverter valve re-directs a majority of the exhaust stream away from the fuel chamber and into the scrubber cell. In this way the saturated fuel vapor pressure is maintained at a level such that the chemical energy per unit volume is relatively high. This allows high thermal power to be generated in the heat sheet with the air pump operating in a relatively low flow condition. For instance, at 85° F. the saturated vapor pressure of liquid methanol is about 155 mm Hg. A 300 cc/minute air flow, directed into the fuel chamber and becoming saturated with the methanol vapor, will provide an equivalent chemical energy in the flow stream of approximately 30 watts. Since the saturation vapor pressure above a liquid increases rapidly with temperature, a small increase in the thermostatic set point can provide substantially more power if desired. This power is then shared among the heat elements in any manner, such that the channel wall temperatures do not exceed the damage threshold for the particular materials chosen for the heat sheet and heat elements.

Any over temperature condition within the heat sheet is prevented by use of embedded temperature sensors which can turn off the air pump when such a condition is detected. In one embodiment, these sensors, are constructed as thin film conductors, of predetermined resistance value, with a known temperature coefficient of resistance. They can be designed as an integral part of the heat element and can play a dual role by also acting as transient electrical pulse heaters. In the role as a pulse heater, they would provide a quick start to each catalytic heater element in the event of extreme cold start-up conditions or in case it is desired to regenerate catalytic heat elements that have become dormant from long term storage.

Because the channels within the heat sheet have a very small physical volume, the heat generating process ceases within a few seconds when the fuel-air flow stream is terminated, as will occur when the air pump is turned off. Similarly, the heat process terminates in a few seconds if the fuel/air ratio is reduced to negligible levels.

BRIEF DESCRIPTION OF THE DRAWINGS

These and other features, aspects and advantages of the present invention will become better understood with regard to the following description, appended claims, and accompanying drawings, where:

FIG. 1 is a cut-away plan view of a heat generating elastomeric sheet (heat sheet);

FIG. 2 is a battery operated miniature electric air pump;

FIG. 3 is a cross-section view of a combined air flow regulator and fuel module interface body;

FIG. 4 is a side view of a fuel module with, a fuel chamber, exhaust scrubber cell and diverter valve;

DETAILED DESCRIPTION OF THE EMBODIMENTS

Figures 7, 8, 9, 10:
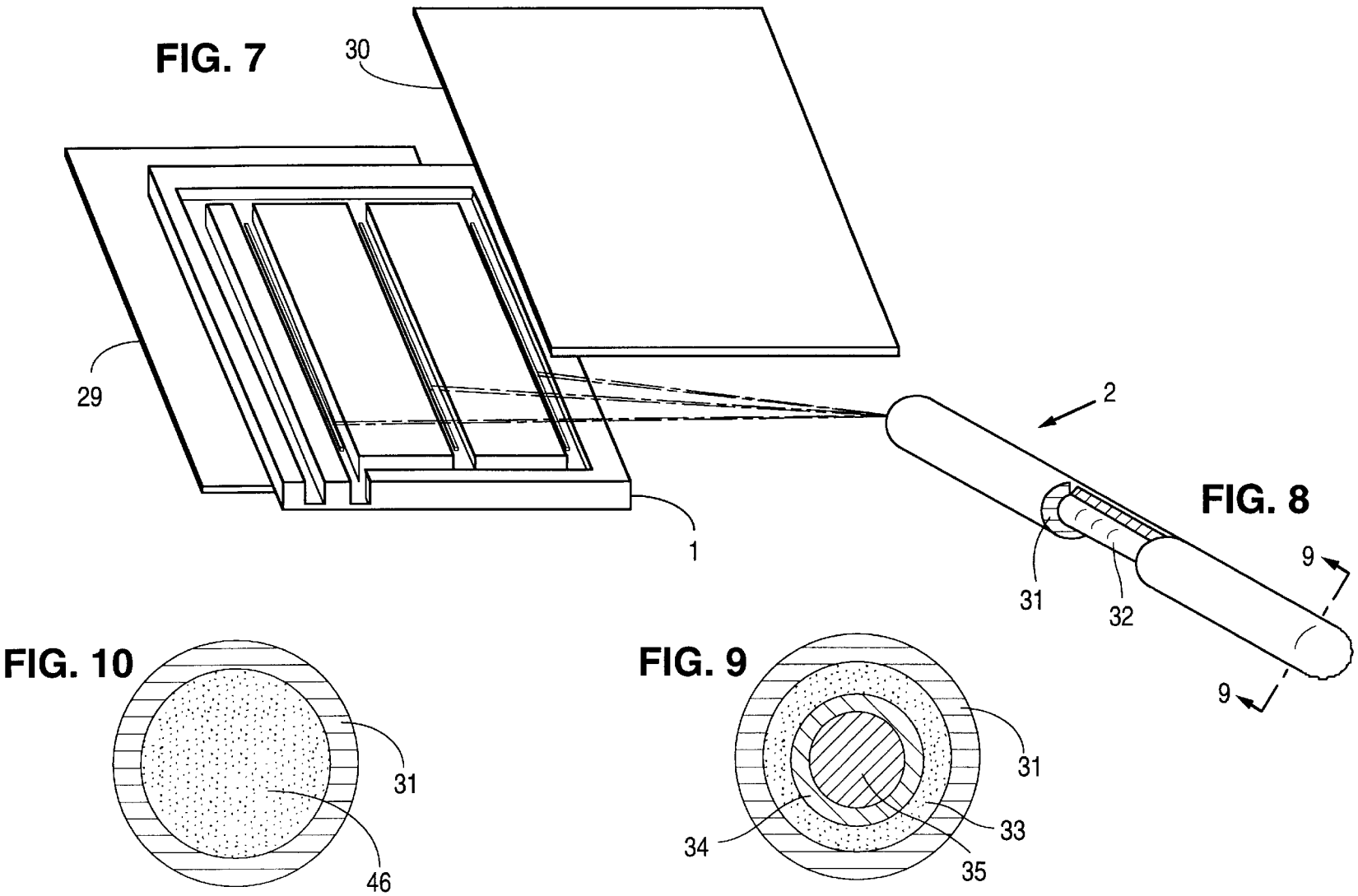
FIG. 7 is a cut-away perspective view of the heat sheet shown in FIG. 1.
FIG. 8 is a partly cut-away perspective view of an elongated catalytic heat element showing a general heat element morphology.
FIG. 9 is a cross-section view of an elongated catalytic heat element with a core of aluminum wire coated with a catalyst.
FIG. 10 is a cross-section view of an elongated catalytic heat element with a core of granular alumina coated with catalyst.

FIGS. 1 and 7 show plan view and perspective view of one embodiment of a heat generating sheet, containing flow channels 5 in a sheet core 1 consisting principally of an elastomeric material. Fuel-air vapor is pumped from a fuel chamber 20, shown in FIG. 4, into flow channels 5, within sheet core 1, containing elongated catalytic heat elements 2. The pumping action is provided by a miniature electric air pump 6, shown in FIG. 2, which is powered by a dry cell battery 25.

A possible alternative to using dry cell battery 25, is to employ direct electrolytic oxidation of a fuel 22, using a device known as a fuel cell. For instance, if the fuel in fuel chamber 20 is a primary alcohol, such as methanol, the present invention might use a portion of it to operate a miniature fuel cell structure and thus derive a small amount of electrical power (e.g. ¼ to ½ watt) to drive air pump 6. In this manner, all the energy required to operate this invention could be obtained from a single source of renewable energy. For certain applications, this would be both a cost effective and practical way to eliminate the need for batteries.

The heat generating process begins by closing pump switch 26, which routes current from battery 25 into electric air pump 6, starting the flow of air. Ambient air enters an input port 7 and exits through an output port 8, which is connected by a plastic tube to a regulator interface shown in FIG. 3. At the regulator interface, the air stream is divided between a fuel valve 9 and a dilution valve 11. Valve 9 controls the rate of flow of air passing through a conduit located in the interface body 13 and then through a quick-connect seal 45 into a fuel chamber inlet tube 14. Fuel chamber inlet tube 14 carries the air stream directly into a fuel vapor extraction unit 23 which is immersed in liquid fuel 22 shown in FIG. 5. The fuel chamber is an isolated subsection of fuel module 28 which contains both fuel chamber 20 and a scrubber cell 21.

Figure 6:
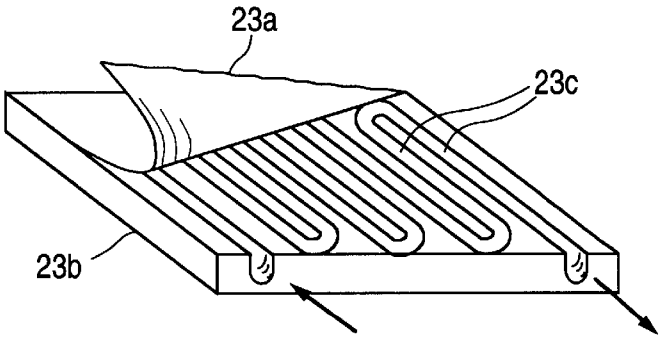
FIG. 6 is a partly cut-away perspective view of the fuel vapor extraction unit within the fuel chamber shown in FIG. 5.

A partly cut-away perspective view of the fuel vapor extraction unit 23 is shown in FIG. 6. It consists of a vapor extractor base 23B with a serpentine shaped groove 23C formed into its face. Vapor extractor base 23B can be made from any material compatible with the fuel. For a methanol based liquid fuel, a material such as high density polyethylene has been found suitable. A micro-porous membrane 23A is placed over the vapor extractor base 23B, covering but not filling the serpentine shaped groove 23C, and sealed to the base by use of an adhesive or by other means such as heat sealing. The result is an assembly containing a serpentine passage through which gasses are allowed to move unimpeded. Air flowing into vapor extraction unit 23 remains separate from the liquid phase fuel 22, because the membrane is chosen such that capillary forces prevent liquid fuel 22 from entering serpentine groove 23C via the pores of membrane 23A. The micro-porous membrane can be made from expanded PTFE. An internodal distances of 20 microns or less and a thickness of 1 millimeter has been found to work satisfactory. Other materials, for example, polyethylene, can also be used as long as the membrane is sufficiently hydrophobic and the pore size sufficiently small. If methanol is chosen as liquid fuel 22, a small amount of de-ionized water must be added to the methanol in order to prevent the methanol from wetting the membrane and seeping into serpentine shaped groove 23C. The complete miscibility of water in methanol, along with its highly polar nature, increases the surface tension of the fuel so that only the vapor phase of the fuel can enter the capillary-like internodal spaces of membrane 23A. It has been found that a 10% to 15% by volume addition of water is sufficient to insure separation of the gas and liquid phases. The use of other additives to raise the overall surface tension of the fuel should also work well.

This method of vapor extraction has advantages over direct bubbling of air through the fuel. One advantage is its immunity to accidental leakage and back flow problems when the fuel module is inverted or placed in unusual attitudes. This should also be true for weightless or micro-gravity conditions. The technique of bubbling air directly through the fuel requires more complex design to avoid this problem and has the additional drawback of generating somewhat higher back pressure do to the hydraulic head of the liquid fuel.

Upon passing through vapor extraction unit 23, the air stream becomes saturated with fuel vapor and exits a fuel chamber outlet tube 15, where it is directed back to interface body 13 and mixed with air from dilution valve 11. Interface body 13, is designed to couple and de-couple with fuel module 28. In this manner, replacement fuel modules may be easily and quickly removed and re-inserted by means of interface body quick-connect couplings 45. The settings for fuel valve 9 and dilution valve 11 determine the fuel/air ratio of the gas stream entering heat sheet inlet tube 3. A fuel-air control knob 10, mechanically links valve 9 to valve 11 such that rotating control knob 10 increases or decreases the fuel/air ratio. In this manner the thermal power generated in the heat sheet may be selected and controlled by the user. Alternatively, the air pump flow rate can be adjusted by controlling the electric current into the motor that drives air pump 6 and setting the fuel/air ratio at predetermined fixed value.

A combination of both methods (i.e.fuel-to-air ratio and total flow rate control) is most desirable since this would provide the widest range of operating conditions. In this way, it is possible to insure catalytic heat element 2 operates along the most desirable portions of the power curve. This is shown as example only, without implying limitation, in FIG. 15, labeled as curves C1 and C2. These curves, described in detail below, form the upper boundary of the operational regime where condensed water vapor effects are prominent. Different curves will result for each heat sheet design and are calculated by determining the channel wall temperature, under a given set of flow and power conditions, and the humidity of the flow stream due to the rate of production of the $H_2O$ reaction product.

Upon entering the heat sheet, the fuel-air flow stream is directed to a plurality of flow channels 5 containing elongated heat element 2, where the fuel reacts with oxygen in the presence of a catalytic material to generate heat by flameless combustion. Sheet core 1 of the heat sheet is sandwiched between a flexible upper sheet 30 and a lower sheet 29 that are substantially thinner than the sheet core. The purpose of the bottom sheet includes but is not limited to physical support for sheet core 1. For instance, if the channels in the sheet core are formed by the method of embossing or molding, so that the thinnest portion of the sheet core (occurring in the channel sections as shown in FIG. 7) is sufficient to prevent fuel vapor from diffusing out to the environment during operation of the heat sheet and the physical integrity of the heat sheet is not compromised, then the bottom sheet may be considered optional. Bottom sheet 29 can also be used to help spread the heat across the surface, as for instance by using a thermally conducting polymer or metal foil, or it may be added solely to adjust the overall mechanical rigidity of the whole heat sheet structure. Alternatively, if sheet core 1 is constructed of individual die-cut pieces, bottom sheet 29 acts as a substrate upon which the die-cut pieces are bonded to form an integral single unit with flow channels. In this case, bottom sheet 29 actually forms the bottom of the channel. The top sheet is put in place after the catalytic heat elements are positioned and secured within the flow channels. Its function includes, but is not limited to, containment of the fuel-air flow within the flow channels and must therefore also be impermeable to fuel vapor. In any case, the choice of materials for the top and bottom sheets is dependent upon the sheet core material, bonding technique, fuel vapor compatibility, overall mechanical properties and the peak operating temperature desired of the heat elements.

Figure 14A:
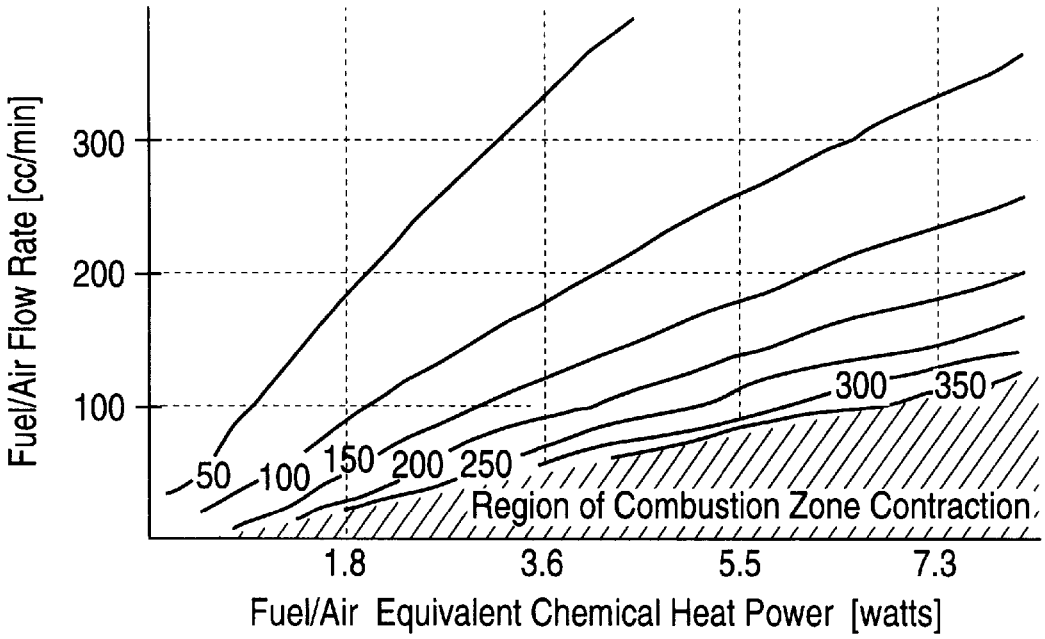
FIGS. 14A & 14B is a diagram of fuel-air flow rate versus equivalent chemical thermal power contained in flow stream, showing a region of combustion zone contraction.

One such embodiment of a heat sheet with dimensions, which are given by way of example and not limitation, consists of: a sheet core of RTV polyurethane 15 cm×10 cm×0.3 cm with molded channels, no bottom sheet 29, and a top sheet b of 0.127 millimeter thick mylar that is aluminized on one side. Heat elements 2, are 12 cm long and 0.18 cm in diameter, constructed as shown in FIG. 8 and FIG. 9. Each heat element has a micro-porous PTFE outer-jacket 31, purchased from International Polymer Engineering, with an internodal distance of less than 20 microns, a 1 mm inner diameter and 1.8 mm outer diameter surrounding a catalytic core 32. The micro-porous membrane allows the fuel vapor to reach the catalyst and the reaction products to escape but prevents condensed water vapor in the flow channels from contacting the catalyst. The catalytic core composition, delineated in FIG. 9, consists of an aluminum wire 35 with a clear anodized surface 34 and a reaction promoting catalyst outercoat 33. The catalyst consists of 50 micrometer diameter gamma-alumina particles coated with about 40% by weight platinum. (Gamma-alumina, coated with between 20% to 60% by weight Platinum, will auto-ignite methanol vapor at ambient temperatures lower than 40° F. and in relative humidity levels near 100%). The particles are attached by using a saturated aluminum nitrate and water solution formed into a slurry with the platinized alumina particles and painted onto the surface of the wire with a brush. The wire is baked at 450° C. for 2 hours. U.S. Pat. Nos. 2,580,806 , 2,742,437 and 2,814,599 describe details useful for producing a satisfactory composition of active platinum coated particles and for attaching said particles to a surface. Aluminum wire 35 provides a high degree of axial thermal conductivity to heat element 2 and contributes substantially to the apparent uniformity of the flameless combustion process along the axis of the heat element. The high axial thermal conductivity further provides for a wide operating regime with a relatively small region of combustion zone contraction as shown in FIG. 14A.

Figure 13A:
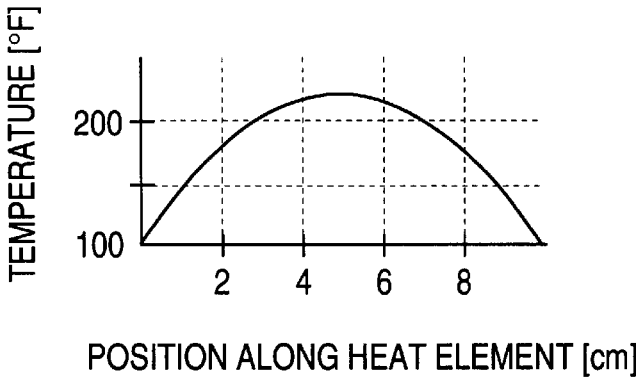
FIGS. 13A & 13B & 13C are temperature versus heat element axial position diagrams showing the effect of axial thermal conductivity on combustion zone temperature profiles.
Figure 13B:
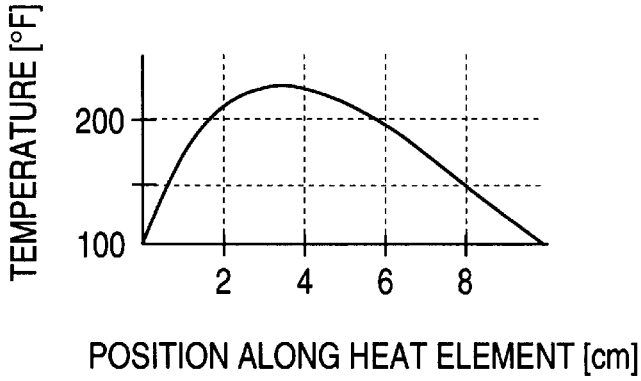
Figure 13C:
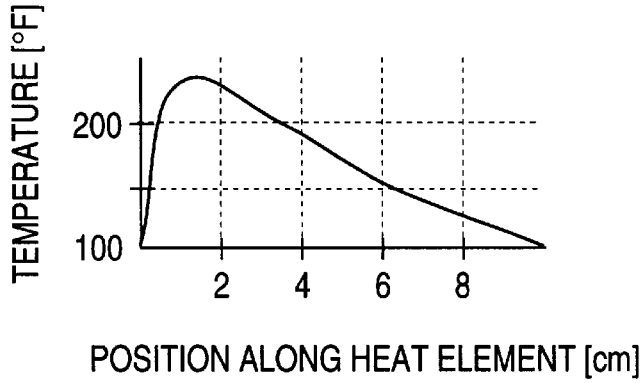
Figure 14B:
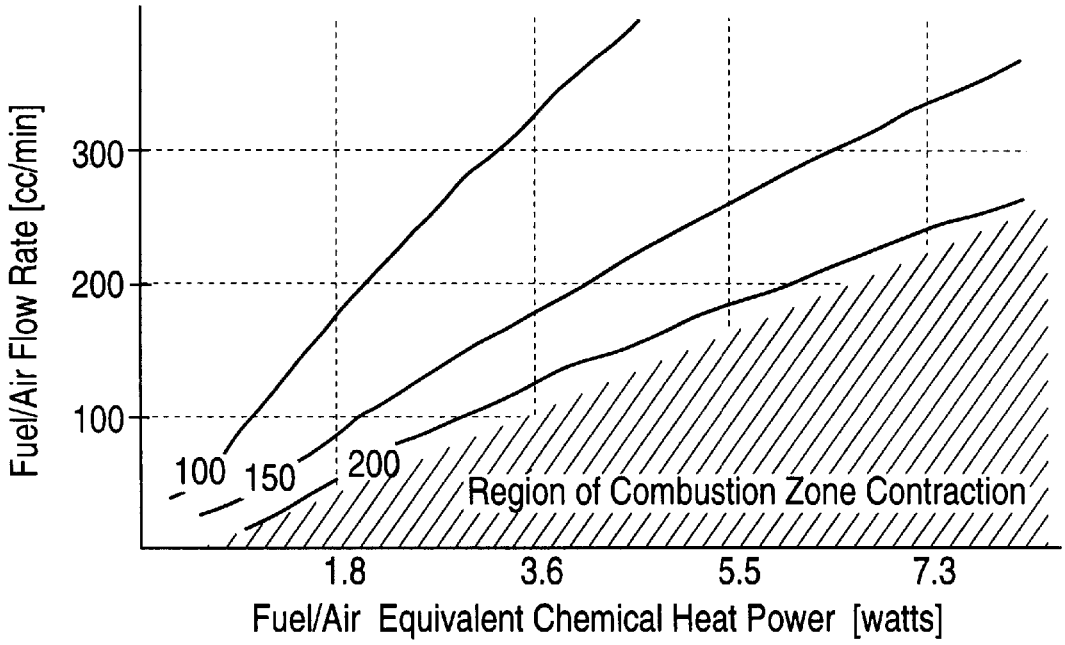

In contrast, FIG. 10 shows a heat element construction with a catalytic core 32 consisting of minute particles (e.g. 50 micron to 250 micron average size) of gamma-alumina coated with 20% to 60% by weight platinum but without a central metal wire. This structure has significantly less axial thermal conductivity than the one shown in FIG. 9. FIG. 14B demonstrates the substantial restriction in operational performance that results. The significantly lower axial thermal conductivity value results in a substantially larger region occupied by combustion zone contraction. The combustion zone contraction boundary defines a state where the temperature at the center of the heat element just starts to equal the temperature of the heat element at the fuel-air entrance. It is arbitrarily chosen to represent the beginning of an asymmetry in the temperature profile, along the axis of the heat element, that progresses gradually toward a condition where the majority of the combustion process is occurring in a small region at the fuel-air entrance. In FIGS. 14A and 14B, the asymmetry in the temperature profile becomes more pronounced for operating conditions going into and farther away from the upper boundary of the combustion zone contraction regime. FIG. 13C illustrates a typical result. The primary difficulty of operating in this region results from the high power density due to localized combustion, whereby one obtains a high temperature in a small area rather than a low temperature over a large area, as desired. To avoid operating in the combustion zone contraction regime with this type of heat element construction, it is necessary to increase flow rates and reduce the fuel/air ratio significantly, thus resulting in inefficient operation (e.g. greater air pump power requirements, size and weight).

A heat element constructed like that of FIG. 10 can be made to perform similar to the heat element of FIG. 9 by attaching a high thermal conductivity strip of material, running the length of the element, to the micro-porous outer-jacket 31, as discussed in "theory of heat element operation" below. It is preferred that the material be flexible and pliant, for instance, the use of miniature metallic-link structures, such as used in the making of very fine jewelry chains, has been found effective when attached at intervals to the outer-jacket 31, using epoxy. The resulting heat element is very light weight, and flexible while retaining the high average axial conductivity desired to avoid combustion zone contraction.

The heat elements need not have a straight geometry. For instance, the heat elements may be curved into a serpentine shape, or some other shape, in order to alter the manner in which thermal energy flows across the heat sheet. This is practical because the catalytic heat elements may be constructed with non-rigid materials when operated at the relatively low temperatures encountered in this invention.

In one embodiment, the heat elements are placed into each of three parallel flow channels as shown in FIG. 7, and secured by a drop of epoxy at each end of the heat element. The aluminized side of the mylar top sheet is bonded to sheet core 1 by applying a thin coating of uncured RTV polyurethane to the top surfaces of the sheet core followed by setting top sheet 30 onto the surface with subsequent curing. The aluminum film on the mylar sheet reduces the fuel vapor permeability to insignificant levels while spreading the heat produced and reflecting the thermal radiation back into flow channels 5 and sheet core 1. This material combination has been found to work well with heat elements operating continuously at temperatures as high as 250° F. In other embodiments, different material combinations are possible that will allow continuous heat element temperatures above 250° F. (e.g. 300° F. to 400° F.). For instance, high temperature polymeric materials such as, silicone RTV from Dow or closed cell silicone foam sheet from Rogers corporation, can be used while still maintaining a pliant and flexible physical character of the heat sheet. In addition, the use of closed cell foam as a sheet core material offers significant weight reduction over non-foamed elastomer counter parts.

The total number of separate flow channels, with heat elements, contained in a heat sheet, is limited only by the air pump flow capacity and the fuel module capacity to supply saturated fuel vapor. A small flow channel cross-sectional area is preferred since it causes the flow velocity within the channel to be relatively high even though the total volume rate of flow may be relatively low. A high flow velocity reduces the ratio $H_2/V$ (discussed in the section on "theory of heat element operation") and has a strong influence on the symmetry of the temperature distribution (combustion uniformity) along the length of the heat element. Therefore, by constructing heat elements with very small cross-sectional areas it is possible operate well outside the region of combustion zone contraction while still maintaining a low volume flow rate condition. This in turn allows effective use of miniature electric air pumps as the source of oxygen and carrier gas for the fuel vapor. A trade-off occurs between flow channel cross-sectional area and pump pressure required to achieve a particular flow rate, so that flow channel cross-sectional area may not be reduced ad-infinitum. It is therefore important to combine high axial thermal conductivity with a low $H_2/V$ ratio (e.g. a ratio less than one, when $H_2$ has units of watts and V has units of centimeters per second).

Figure 11B:
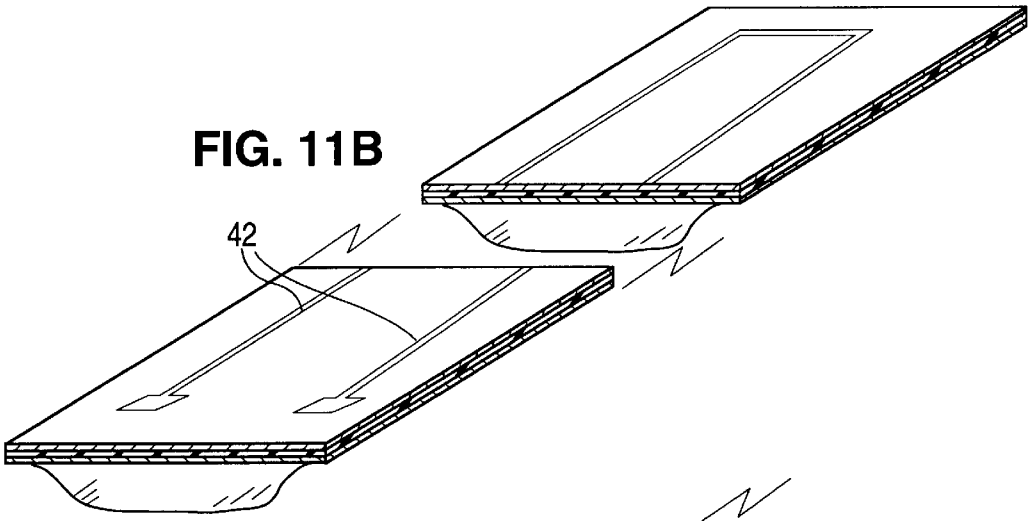
FIGS. 11A & 11B are a perspective view of top and bottom respectively of an alternative construction for an elongated catalytic heat element with a slim profile and bottom-side resistor.
Figure 11A:
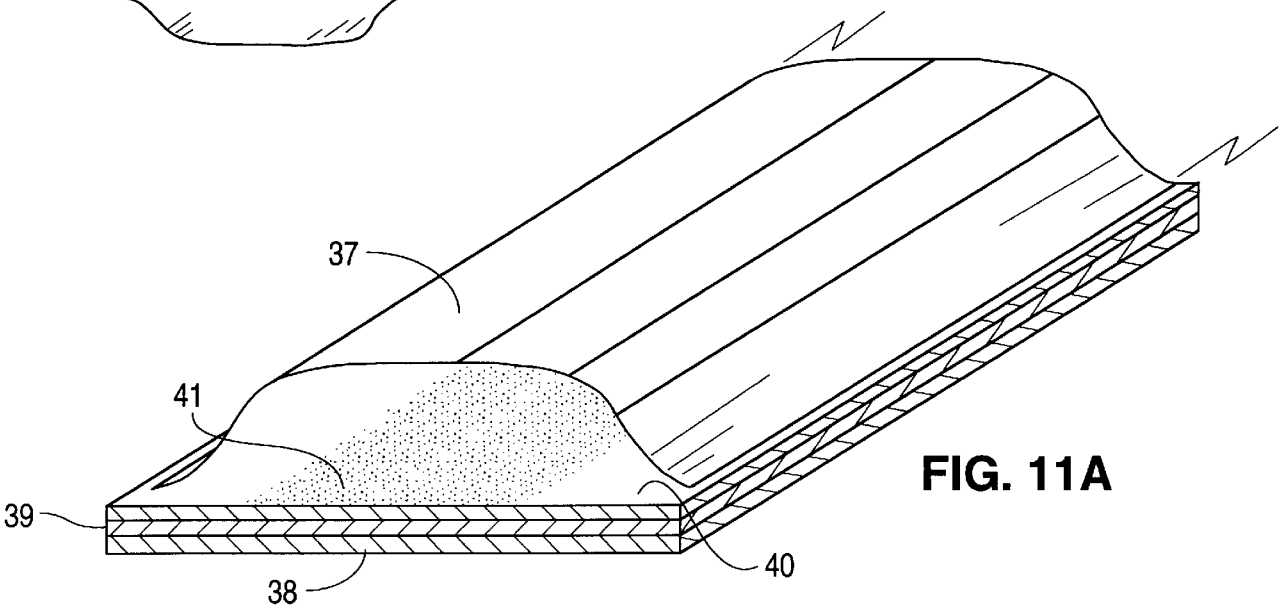

Heat elements constructed similar to those shown in FIGS. 11A and 11B take advantage of the benefits of small flow channel cross-sectional area by being very thin in profile. The heat element is constructed by sandwiching the catalyst between a flat, thin, nonporous substrate, such as aluminum foil 39, and a micro-porous sheet membrane 37, resulting in a two sided structure. Hydrophobic materials such as PTFE, PVDF, polyethylene, polypropylene and other may be used for micro-porous sheet membrane 37. The use of PTFE material has the advantage that the pore structure remains unimpaired up to about 400° F. to 450° F.

Figure 12:
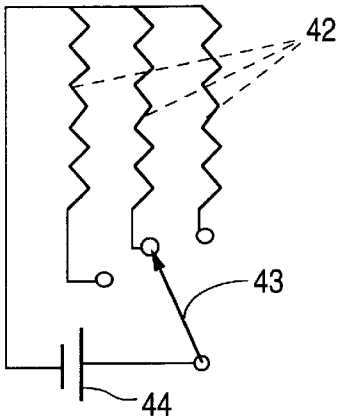
FIG. 12 is an electric circuit schematic drawing of a heat element starter circuit.

In one embodiment, a top surface 40 and bottom surface 38 of the thin profile heat element shown in FIG. 11A consists of anodized aluminum. Top surface 40 has a thin stripe of a reaction promoting catalyst 41 running along the length of the heat element. The sheet-like micro-porous membrane is sealed at the edges, where it contacts the anodized aluminum foil, by use of a thin layer of epoxy. The attachment contact area must be sealed such that it is impervious to penetration by condensed water vapor that may occur in the flow channels. Other attachment means may be utilized such as localized heat, mechanical or other types of adhesives. Back surface 38 has a thin film resistor 42 deposited as shown in FIG. 11B. By driving current through thin film resistor 42, a joule heating effect raises the temperature of the attached reaction promoting catalyst 41. It has been observed that long term dormancy of the heat elements (e.g. three to four months or more between operation) may result in excessive auto-ignition times (e.g. 5 minutes) or on occasion, no auto-ignition. Like-wise, start-up from temperatures well below 40° F. may also be problematic, although generally speaking the body temperature is sufficient to warm the heat sheet above 40° F. in most conceivable situations. To remedy this, a thin film electrical conductor 42 of suitable resistance is attached to and run along the length of the heat element. The joule heating is attained in the form of a transient heat pulse when electric current is momentarily applied. For instance, it has been found that a one second pulse of current of ⅓ amp into a 9 ohm thin film conductor, deposited along the length of an anodized aluminum foil strip, 4 mm wide×150 mm long× 0.012 mm thick will cause the foil temperature to exceed 160° F. This is sufficient to restart even the most inactive heat elements. In one embodiment, two AA sized batteries in series, are switched from element to element, in one second intervals. The switching from element to element may be accomplished either manually as shown in FIG. 12 where starting battery 44 is connected sequentially by switch 43 to each thin film electrical conductor 42. Although a parallel connection is possible, a series connection reduces the demand requirements from battery 44, allowing battery 44 to be functionally merged with battery 25 that drives air pump 6. The switching process may be accomplished more conveniently by use of integrated circuit electronic switching means well known in the art of electronic engineering. In this way, the push of one button will operate air pump 6 and start the heat pulses to thin film electrical conductor 42. Once a catalytic heat element has been reactivated, it has been found to remain active unless once again placed into long term dormancy. Therefore, the power drain on the batteries are normally negligible because the heat pulses are seldom needed. Alternatively, the thin film resistor 42 could be used as a standard method of starting the heat elements. In this mode, the weight percentage of platinum used in the catalytic heat elements may be reduced substantially in order to gain a cost reduction.

Numerous methods are known in the art for generating a thin conductive film of a predetermined resistance. In one embodiment shown in FIGS. 11A & 11B , the substrate is a 12.7 micron thick aluminum foil 39 with top side 40 anodized to a thickness of about 2 microns and bottom side 38 similarly anodized. The foil 39 is 4 mm in width by 100 mm long. The back side is coated with photoresist and exposed to a contact mask. The photoresist is developed, exposing the anodized aluminum surface in a pattern similar to that shown in FIG. 11B. A thin film of electroless palladium is next deposited on to the back side. This is done by dipping the foil into a palladium chloride solution and then a stannous chloride solution which reduces the palladium ions to a metallic form. The foil is then placed into an electroplating bath where the palladium film is grown. The resistance of the backside palladium conductor is checked during the deposition process until a 9 ohm value is achieved. At this point the deposition is stopped and the remaining photoresist is removed. The foil is washed in boiling de-ionized water for five minutes and dried. A slurry of platinum coated gamma-alumina particles (40% by weight platinum on 50 micron particles) is made by mixing with a saturated solution of aluminum nitrate. The top side 40 of the foil is then painted with the slurry solution and placed in an furnace at 450° C. for two hours. The foil is removed from the furnace and cooled to room temperature. A 4 millimeter wide by 100 millimeter long strip of stretched and sintered, micro-porous PTFE, with internodal distance less than 20 microns, is laid over top side 40, sandwiching reaction promoting catalyst 41 in between. The edges of the PTFE sheet membrane 37 are sealed to the aluminum foil with a thin coating of epoxy, being careful not to coat the catalyst, and allowed to cure. The total thickness of the completed heat element is approximately 0.2 millimeter. Other hydrophobic porous membranes such as PVDF, polyethylene, polypropylene and the like will also work depending on the pore size and maximum operating temperature desired.

The use of CVD (chemical vapor deposition) , PVD (physical vapor deposition), vacuum evaporation, silk screened conductive inks and other deposition and pattern transfer techniques are deemed suitable for the construction of thin film conductor 42. The use of a metal foil as the substrate for receiving the reaction promoting catalyst has the advantage of providing a high axial thermal conductivity, enhancing the uniformity of the flameless combustion process along the heat element. Non-porous substrates that are not intrinsically good thermal conductors, such as polyimide or PEEK, can be utilized if modified. For example, lamination with or deposition of metal film structures or external attachment of thermal conducting strips of material in proximity with or contiguous with the substrate will act to effectively increase the axial thermal conductivity of the substrate.

Thin film conductor 42 can simultaneously be used in the role as a temperature sensor. Because electrically conductive materials have a temperature coefficient of resistance, it is possible to calibrate the resistance value of the conductor with its temperature. During operation of the heat sheet, the temperature of each heat element may be sensed by use of electronic circuitry, well known in the art, that can measure the resistance value and shuts down the air pump when a predetermined over-temperature condition is sensed. Alternatively, the thin film conductor 42, can be constructed by using two different metals such that the left side portion of the conductor in FIG. 11B is a metal composition with a different thermoelectric potential than the right side portion, so that where they meet, an overlapping junction is formed producing a thermocouple sensor.

Figure 15:
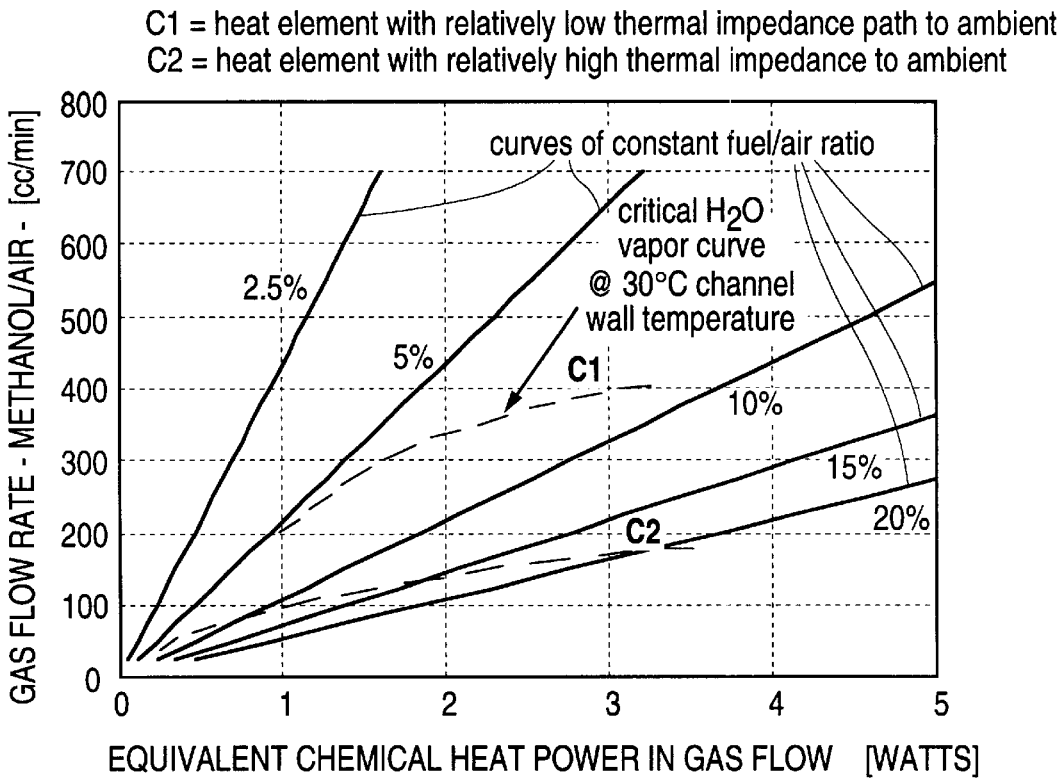
FIG. 15 is a diagram of fuel-air flow rate versus equivalent chemical power contained in flow stream, showing critical $H_2O$ vapor curves.

The utility and importance of a micro-porous membrane encapsulating a reaction promoting catalyst can be understood by considering FIG. 15. This figure shows an empirically derived relationship between total gas flow rate and two critical vapor curves for flow in a 4 millimeter diameter channel. The critical vapor curve is defined here to mean the boundary of the region where noticeable condensation can first be observed in the immediate vicinity of the heat element (i.e. any region below the curve results in noticeable $H_2O$ condensation). The straight curves radiating from the center of FIG. 15 are the curves of constant fuel/air ratio. They are defined with respect to the fuel/air ratio that would exist in the saturated vapor state in equilibrium with liquid methanol at 25° C., which is arbitrarily defined as 100%. (The 5% percent curve corresponds to approximately 1% by volume of methanol vapor in air). Note that the 5% curve delineates the condition for water condensation to occur when the average temperature of the channel wall is about 30° C. and the flow rate is as shown in the diagram. By allowing the flow stream and heat element channel wall to reach higher average temperatures, but still well below the damage threshold for the material chosen, curves like C1 and C2 result. Curve C1 illustrates a situation where the heat element is very well thermally grounded (i.e. relatively low thermal resistance for heat flow to the ambient outside environment) such that the average temperature of the inner channel wall surfaces is not allowed to exceed about 125° F. Curve C2 results when the operating conditions are set to allow greater average channel temperatures of perhaps 150° F. or more. (Average channel wall temperatures of 250° F. or more are practical if for instance the sheet core 1 is chosen to be a high temperature elastomer). Since water at atmospheric pressure changes phase at 212° F., wall temperatures above this value prevent condensation around the heat element regardless of fuel/air ratio. In practice, however, field conditions will arise where the heater operating point crosses into the region below the critical vapor curve boundary resulting in condensed water in the flow channels.

It is also desirable to operate with low flow rate conditions, in order (e.g. for example 50 cc/minute or less per heat element) to reduce the air pump power consumption, size, weight and noise. Maintaining high power levels under these conditions may require relatively rich mixtures, for instance, values exceeding 50% or more. As seen in FIGS. 14A and 14B, this tends to push the operating point into the region of combustion zone contraction. At the same time, as seen in FIG. 15, the operating point tends toward a critical vapor curve. Therefore, the use of a micro-porous membrane, to prevent extinguishment of the catalyst reaction, combined with the methods discovered for promoting a symmetric axial temperature profile, allows the widest latitude for reliable operation, utility and optimum performance of this invention.

The effect of axial thermal conductivity on the combustion process can be inferred by measuring the heat element temperature distribution profile. It is convenient to categorize the flameless combustion behavior into three broad types, as shown in FIGS. 13A to 13C. (For comparison purposes, total power levels were adjusted to keep the peak temperatures similar). Starting with FIG. 13A, the plot illustrates an operational state where the combustion zone appears nearly uniformly distributed over the length of the heat element. In the second state, the reaction zone appears to shift such that the temperature profile is less symmetric, as shown in FIG. 13B. This is interpreted as a shifting of the combustion process toward the fuel-air entrance, which is located at a position of zero centimeters. In the third state (FIG. 13C), the combustion zone appears to have contracted so that most of the thermal power output is occurring in a small portion of the heating element near the fuel-air entrance. In this state, the temperature at the fuel-air entrance portion of the heat element can quickly reach levels (e.g. >600° F.) that will damage known elastomeric materials even at equivalent fuel-air power levels of only a few watts.

The curves shown in FIGS. 13A to 13C are derived from the solution of the differential equation shown in Eq. 1. The parameters were chosen to closely approximate empirical data from heat elements of different axial thermal conductivity. For instance, FIG. 13A is the solution of Eq. 1 with parameters set to approximate the aluminum core heat element (i.e. high axial thermal conductivity) constructed as shown in FIG. 9. FIG. 13C is also a solution of Eq. 1 but with parameters set to fit the data for a heat element structure like that shown in FIG. 10. The construction shown in FIG. 10 significantly lowers the axial thermal conductivity by virtue of the relatively poor thermal conductivity of alumina (aluminum oxide) as compared to pure aluminum, as well as, the significant thermal contact resistance between particles.

I have discovered that by sufficiently increasing the axial thermal conductivity (i.e. the average thermal conductivity value for conductive heat flow along the length of the element) it is possible to convert a heat element, operating with a contracted combustion zone, into one with a significantly more symmetric and extended reaction region. For instance, by attaching a small strip of copper foil (0.001 inch thick by 10 cm long by 0.4 cm wide) to the outside of the heat element that produced the profile in FIG. 13C, a new profile is obtained that looks like FIG. 13A. The average axial thermal conductivity of the heating element shown in FIG. 13A is approximately 10 times the value for FIG. 13C.

Figure 16:
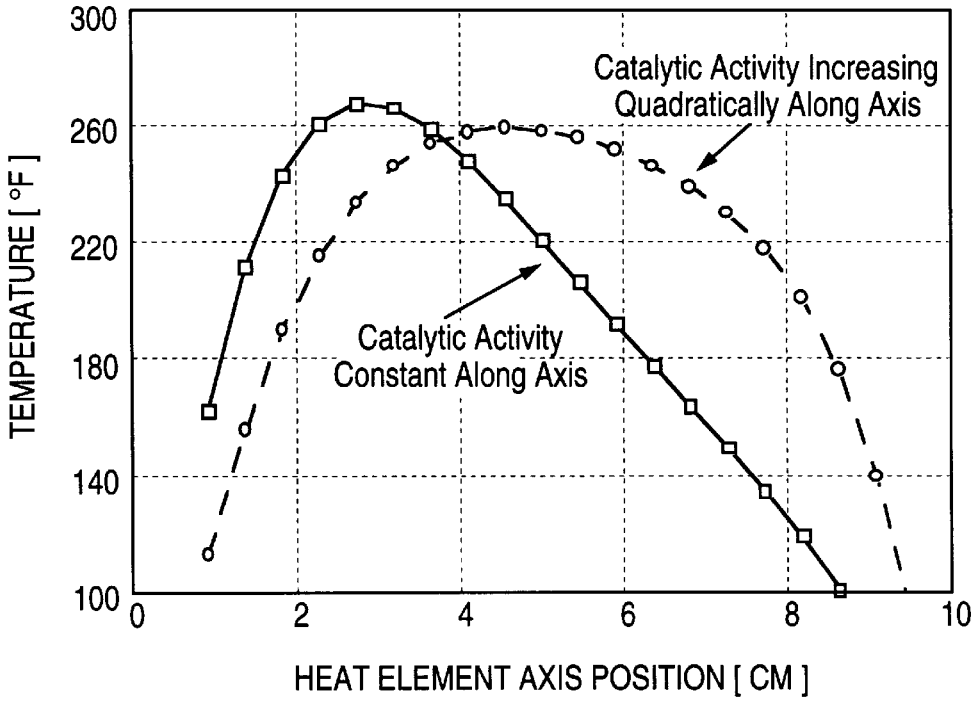
FIG. 16 is a temperature versus axial position diagram showing effect of spatial variation of catalytic activity on combustion temperature profile.

It has been further discovered that the axial temperature distribution can be induced to acquire a substantially more symmetric (more uniform combustion process) temperature profile by spatially modulating the effective catalytic activity along the length of the heat element. This may be done by a number of means, such as altering the porosity of the PTFE micro-porous membrane, so that it is less porous at the fuel-air entrance end and gradually increasing in porosity toward the opposite end of the heat element. For example, this could be done by selectively applying a thin film of epoxy to block specific pores in such a manner that more pores are blocked in some regions than in others. Alternatively, the activity of the catalyst material (per unit length) itself may be altered, as for instance, by mixing inert grains of alumina with activated platinum coated grains of alumina in varying proportions along the axial direction, such that a similar spatial modulation of the catalytic activity is achieved. FIG. 16 demonstrates the predicted effect of spatially modulating the catalytic activity such that it increases quadratically from the fuel-air entrance side to the opposite end of the heat element. The combination of high thermal conductivity and spatially modulated catalytic activity, provides a broad range for heat element performance and axial temperature distribution management.

Figure 5:
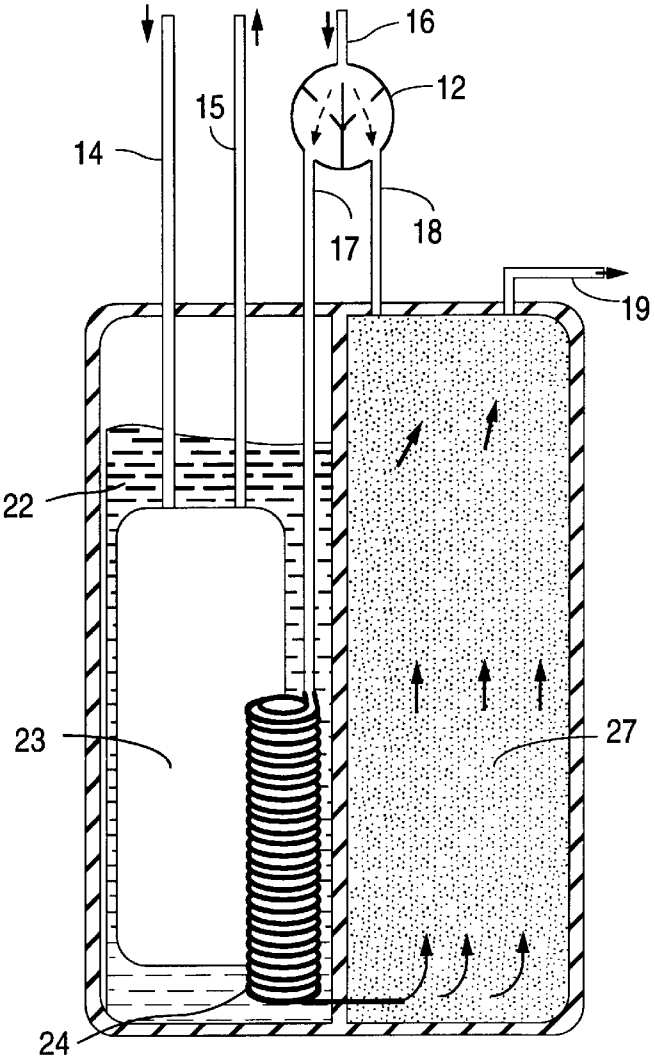
FIG. 5 is a cut-away view of the fuel module shown in FIG. 4.

Returning to the operation of the portable heat generating device; the warm exhaust gas from each of the catalytic heat elements exits the heat-sheet from a common orifice where it is expelled through a flexible plastic heat-sheet exhaust tube 4. Exhaust tube 4 directs the exhaust gas to interface body 13 where the gas passes through a conduit within the interface body and enters diverter valve input tube 16 where it is received by a thermal diverter valve 12. The thermal diverter valve, as shown in FIG. 5, is a bi-directional valve that apportions the exhaust flow stream between two diverter valve output tubes, 17 and 18, according to the temperature of fuel 22 in fuel chamber 20. One means to accomplish this is to utilize a bi-metallic coil of metal that moves a valve stem control in response to the temperature of fuel 20. The temperature of the fuel can be transmitted to valve 12 by way of a heat conducting (e.g. metallic) output tube 17 that connects to an exhaust gas heat exchanger 24. The use of shape memory alloys that change physical shape when transitioning through a predetermined temperature could also provide an effective means to operate the diverter valve. Alternatively, an electronic means for sensing fuel temperature (e.g. thermocouple) and switching power to an electromechanical actuator associated with the diverter valve can also be employed.

When the fuel temperature is below a predetermined set point, the diverter valve directs the warm exhaust into heat exchanger 24. The heat exchanger may consist of a coil of metal tubing or may be formed in any manner that optimizes the exchange of heat between the warm exhaust gas and the liquid fuel. The exhaust gas, after passing through heat exchanger 24, enters into a scrubber cell 21 where it is stripped of any volatile organic compounds (VOC) contained in the exhaust stream. The benign components of the exhaust, $CO_2$ and $H_2O$ vapor, are expelled from the scrubber exhaust tube 19 directly to the ambient atmosphere.

If the fuel temperature is above a predetermined set point, diverter valve 12 directs the exhaust to diverter output tube 18. Diverter output tube 18 circumvents the fuel chamber and heat exchanger, going directly into scrubber cell 21 where it is cleaned of any volatile organic compounds and released to the atmosphere.

The scrubber cell contains absorbents that selectively absorbs VOC's while allowing the $CO_2$ and water vapor to pass through. Many techniques for cleaning exhaust gas are known in the art. Use of a dry absorbent 27, generally known as activated carbon, for example, the coconut shell base type supplied by ADCOA Inc., has been found to provide acceptable performance. A combination of passing the exhaust gas through water, followed by a dry absorbent is even more effective and can absorb 25% to 50% of its weight in VOC's without releasing any detectable quantity to the atmosphere.

THEORY OF HEAT ELEMENT OPERATION

The observation that axial thermal conductivity has an effect on combustion zone behavior and temperature profiles can be qualitatively and quantitatively approximated by modeling the phenomenon as a one dimensional differential heat flow equation. While this simplified approach does not explicitly contain all the parameters normally included in catalytic reactor design (e.g. H. H. Lee: "Heterogeneous Reactor Design", Butterworth Publishers,1985), it has been discovered to have sufficient predictive power to elucidate this portion of the design scheme utilized in the present invention.

$$(K/\sigma p)\nabla^2 T + c\, dT/dx + (H_2 - H_1)T = -H_2 \qquad \text{Eq. 1}$$

Where;

$H_1$=rate of heat energy lost at the surface of the heat element by forced convection of the fuel-air flow stream. For the purposes of this model, radiation loss is considered negligible and conduction loss is axial only (x direction).

$H_2$=equivalent chemical heat power carried in the fuel-air flow stream, all of which is assumed to react at the surface of the heat element where the catalyst contacts the flow stream.

x=axial position along heat element.

T=temperature as a function of axial position.

σ,p=specific heat and density of heat element.

c=a constant proportional to the ratio of $H_2/V$ , where V is the velocity of the flow stream. It represents transport resistance resulting from back pressure at the heat element. Alternatively, it may be viewed as a virtual counterflow term transporting heat in the direction opposite to the main stream flow. This term is primarily responsible for causing the asymmetry in the temperature profiles (i.e. combustion zone contraction or expansion) seen in FIGS. 13A, 13B, 13C and FIGS. 14A and 14B. It illustrates the need for small cross sectional flow channel area, A, in order to keep V high (i.e. V=f/A).

For a fixed volume flow rate f, the term $H_2$ is proportional to the fuel/air ratio and thus explains why relatively high fuel/air ratios tend to exhibit highly non-symmetric temperature distributions unless compensated by the methods described in this invention, such as by increasing the axial thermal conductivity and/or spatially modulating the catalytic activity.

The solution to this equation with constant coefficients and boundary conditions T(0)=0 and T(1)=0, may be expressed as;

$$T(x) = -(H_2/\gamma) + \exp(c/2K)[A_1 \exp(c^2/4K^2 - \gamma)^{1/2} + A_2 \exp - (c^2/4K^2 - \gamma)^{1/2}] \qquad \text{Eq. 2}$$

Where;

$$A_2 = H_2/\gamma - A_1 A_1 = (H_2/\gamma)[\exp(-cl/2) - \exp(-rl)]/[\exp(rl) - \exp(-rl)]$$

and

I=length of heating element $r=(c^2/4K^2-\gamma)^{1/2}$ $y=(H_2-H_1)/K$

The temperature dependence of the catalyst reaction rate constant is approximated by using only the first order term of an assumed Arrhenius temperature dependence. In that case we have; $H_{total}=H_2[1+\alpha T]$. At the relatively low temperatures and operational conditions encountered in this invention, this appears satisfactory as an approximation.

Furthermore, since $H_2$ is proportional to the chemical thermal power content of the fuel-air stream and $H_1$ is proportional to the flow stream velocity, the coefficient, $\gamma$, may be re-written as;

$$(aP-sf^n) \qquad \text{Eq. 2}$$

Where;

P=equivalent chemical thermal power contained in the fuel-air stream, and assumes complete combustion.

f=volume flow rate of the fuel-air stream; where f=flow velocity times channel cross sectional area, A.

K=equivalent axial thermal conductivity of heat element.

a,c=proportionality constants.

n=nominally set to 1.0 but can change depending on geometry of the heat element.

FIGS. 14A and 14B were plotted by substituting Eq. 2 into the solution for Eq. 1 and solving for constants that best fit empirical values of P and f. Physically, the s $f^n$ term relates to the cooling effect of the fuel-air stream on the heat element. The rate of cooling is dependent on such things as temperature, laminar or turbulent flow and properties of the gas itself. This cooling effect is competing with the heat producing effect of the catalytic reaction (i.e. aP). The effect of the K value (axial thermal conductivity) on combustion zone temperature profiles is plotted in FIGS. 13A through 13C. FIG. 14A closely approximates actual performance data of the aluminum core heating element shown in FIG. 9, and FIG. 14B typically results when heat element construction is similar to FIG. 10. The temperature contours shown in FIGS. 14A & 14B are a best fit of the theoretical solution of equation 1 to the actual data obtained for these structures and match within ±15% over the range of flow rates and equivalent thermal powers shown. The contour temperatures are the values obtained at the central axial position along the heat element and are displayed in terms of an increase above ambient temperature. For data collection purposes, the heat element was allowed to rest in a 20 cm long glass tube of 4 mm I.D., with one end of the glass channel connected to a fuel-air supply and the other open to the atmosphere. The upper boundary of the region labeled combustion zone contraction in FIG. 14A, represents the points where the entrance end and middle section of the heat element reach equal temperatures, thus indicating that the temperature profile is becoming significantly asymmetric, as for instance seen in FIG. 13C. The boundary and size of this region will shift as the axial thermal conductivity changes. An increase in thermal conductivity pushes the contraction zone to the right in FIG. 14A, thus causing an apparent shrinking of the area where combustion zone contraction will occur. A decrease in average axial thermal conductivity will have the opposite affect, resulting in a condition where very lean mixtures must be used to avoid contracting the combustion zone. Very lean mixtures require higher flow rates (i.e. pump power, size and weight) to achieve the same thermal power output.

The observation regarding the effect of axial spatial modulation of catalytic activity on combustion zone behavior and temperature profiles, may be qualitatively and quantitatively approximated by modeling the phenomenon as a one dimensional differential heat flow equation of the following type.

$$(K/p)\nabla^2 T+c\ dT/dx+(\epsilon x^n-b)T=-\eta x^n+a \qquad \text{Eq. 3}$$

X=axial distance along heat element axis with the zero point defined at the fuel-air entrance side.

$\epsilon$, b, $\eta$, a=constants n=exponent chosen to approximate actual spatial variation of catalyst activity.

This equation is similar to Eq. 1 except that the coefficient of the temperature term is dependent upon the axial position along the heat element and the forcing function on the right side of the equation changes similarly. It is arrived at by substituting the relation $H_2=\eta x-a$ in the equation $H_{total}=H_2[1+\alpha T]$. A numerical solution of equation Eq. 3 with n=2 and n=0 with suitable boundary conditions is shown in FIG. 16.

These simple models have been found satisfactory in providing reasonable approximation for catalytic heat element temperature distribution over a wide range of input conditions and are good qualitative guides to predict general behavior. They have confirmed the surprising results obtained regarding the effects of thermal conductivity and catalytic spatial modulation on flameless combustion zone behavior.

Conclusions, Ramifications, and Scope

While the preferred application of the present invention has been shown and described, it should be apparent to those skilled in the art that many more modifications are possible without departing from the invention concept herein described. For example, a gaseous fuel and air mixture may be stored in one or more pressurized cylinders (fuel sources) and transported (without pumping) to the heat sheet. Alternatively, a compressed and regulated air source commonly used in SCUBA equipment or a chemically generated source of oxygen rich gas may be substituted for the air pump and still be within the scope of this invention. Also, the fuel may be other than methanol. Moreover, the elastomeric body of the heat sheet may have thermally conductive layers embedded within it to further enhance the conduction and distribution of heat out of the channels and across the surface of the sheet. For example, strips of thin metal foil could be molded into the heat sheet plastic material thereby altering the manner of heat transfer between the heat elements and the body of the heat sheet without affecting the flexibility of the heat sheet. Alternatively, the plastic material of the heat sheet itself could be formulated to increase heat conduction by the use of additives such as metal particles and the like. Similarly, the heat sheet body could be made of a laminate of different elastomeric materials, each with its on unique heat conducting properties.

Therefore, the appended claims are intended to encompass within their scope all such changes and modifications which fall within the true spirit and scope of this invention and should not be determined by the embodiments illustrated, but by the appended claims and their legal equivalents.

I claim:

1. A portable heat generating device, comprising:

(a) an envelope with an inlet and an outlet, having a plurality of internal channels for directing the flow of a gaseous fuel mixture to specific sites within said envelope, a plurality of said channels containing an elongated heat element;

(b) said elongated heat element comprising a reaction promoting catalyst that reacts with a gaseous fuel mixture producing heat, a micro-porous hydrophobic membrane surrounding said reaction promoting catalyst, whereby said micro-porous hydrophobic membrane prevents condensed water vapor within said channels from contacting said reaction promoting catalyst but allows said gaseous fuel mixture to penetrate said micro-porous hydrophobic membrane and contact said reaction promoting catalyst resulting in gaseous combustion products and heat, said gaseous combustion products escape said elongated heat element through said micro-porous hydrophobic membrane;

(c) a fuel source coupled to the inlet of said envelope; and (d) an oxygen source admixing with said fuel source to form said gaseous fuel mixture and transport said gaseous fuel mixture to the inlet of said envelope where said fuel mixture reacts with said elongated heat element producing said gaseous combustion products that are expelled through the envelope outlet.

2. The portable heat generating device according to claim 1, wherein said elongated heat element, comprises:

a reaction promoting catalyst selected from the group consisting of platinum and palladium and rhodium and rare earth family; and a means for increasing average axial thermal conductivity of said elongated heat element substantially beyond the intrinsic thermal conductivity of said reaction promoting catalyst, whereby the axial temperature profile is made approximately symmetric along the length of said elongated heat element.

3. The portable heat generating device according to claim 1, further including:

a spatially modulated elongated catalytic heat element, the catalytic reactivity of the reaction promoting catalyst of said modulated elongated heat element, changing as a function of axial position along the length of the modulated heat element, whereby the axial temperature distribution is made approximately symmetric along the length of said elongated heat element; and a means for spatially modulating the catalytic reactivity of said elongated heat element so that said catalyst reactivity is less at the entry side of said gaseous fuel mixture and increases toward the exit side of said gaseous fuel mixture.

4. The portable heat generating device according to claim 1, wherein the oxygen source, comprises:

a pump having an input port and an output port, oxygen source entering said input port and leaving said output port, oxygen source leaving said output port is transported via a conduit to a gas flow regulator, said gas flow regulator receiving a gas flow from said oxygen source and directing said gas flow into a fuel chamber containing said fuel source, rate of said gas flow into said fuel chamber controlled by a first valve; and said gas flow emerging from said fuel chamber, containing substantial fuel vapor content, is received again by said gas flow regulator, diluted with said oxygen source to achieve a predetermined fuel-to-air ratio, level of dilution controlled by a second valve.

5. The portable heat generating device according to claim 1, further including:

a heat exchanger comprising an inlet, outlet and at least one internal passageway through which said gaseous combustion products are conveyed, said inlet receiving warm exhaust gas from said envelope and directing said warm exhaust gas to said passageway, said passageway in thermal contact with said fuel source, said outlet expelling said exhaust gas after transferring heat energy to said fuel source; and a means for redirecting the path of warm exhaust away from said inlet of said heat exchanger when said fuel source temperature achieves a predetermined value, whereby said fuel source temperature is regulated.

6. The portable heat generating device according to claim 2, wherein the means for increasing the average axial thermal conductivity of said elongated heat element, comprises:

an elongated, high thermal conductivity strip of material, at least the approximate length of the heat producing portion of said elongated heat element and in proximity with said elongated heat element, made largely of material selected from the group consisting of metal foil and metal film and metal wire and metal film-polymer laminates and metal links and metal filled polymers and metal oxides and metal oxide filled polymers, whereby the average axial thermal conductivity of said elongated heat element is increased substantially beyond the intrinsic thermal conductivity of the reaction promoting catalyst.

7. The portable heat generating device according to claim 4, further including a fuel vapor extraction unit located within said fuel chamber, comprising:

a base member with a groove or recess in the surface of said base, a sheet shaped micro-porous hydrophobic membrane, substantially hydrophobic in nature and of similar shape and area as said base member, with a top surface and a bottom surface, said micro-porous hydrophobic membrane is placed over the grooved surface of said base member, the bottom surface of said micro-porous hydrophobic membrane is attached to said base member by a sealing means such that only the grooved surface remains free of contact with said micro-porous hydrophobic membrane, the combination of said base member and said micro-porous membrane form a conduit or channel, a portion of said channel being porous along said channel length, one end of said conduit receives a gas flow from said oxygen source entering said fuel chamber, the other end of said conduit is connected to an outlet of said fuel chamber; whereby when a liquid fuel source, contained in said fuel chamber, is contiguous with the outside surface of said micro-porous hydrophobic membrane, said liquid phase fuel is prevented from entering said conduit by the hydrophobic nature and capillary forces of said micro-porous hydrophobic membrane, fuel in vapor phase passes through the pores in the membrane and enters said conduit, gas flow through said conduit, from said oxygen source, mixes with said fuel vapor and carries it to fuel chamber exit;

an additive means for increasing the surface tension of said liquid phase fuel, whereby the capillary forces preventing said liquid phase fuel from entering said conduit, in said vapor phase extraction unit, through said pores of said micro-porous hydrophobic membrane, are increased substantially beyond the intrinsic value of said liquid phase fuel.

8. The portable heat generating device according to claim 1, further including an exhaust gas scrubber, comprising:

an air-tight cell or chamber with an inlet and outlet, located between said envelope exhaust orifice and ambient environment, said inlet connected to the exhaust orifice of said envelope, said outlet releasing treated exhaust gas to the ambient environment;

an exhaust gas treatment means, wherein volatile organic compounds in said exhaust gas, enter said inlet to the gas scrubber cell and are removed from said exhaust gas, rendering said treated exhaust gas substantially free of harmful components.

9. The portable heat generating device according to claim 8, wherein the exhaust gas treatment means comprises:

activated carbon grains contained within said air-tight cell and arranged such that said exhaust gas entering said inlet to the gas scrubber must pass through the activated carbon before exiting to the ambient environment through said outlet of said air-tight cell.

10. The portable heat generating device according to claim 2, wherein said elongated heat element, comprises:

a flat elongated non-porous substrate, with a top surface and a bottom surface, said reaction promoting catalyst attached to said top surface;

a micro-porous hydrophobic plastic membrane material with pore size sufficiently small to prevent liquid phase water from passing through said micro-porous hydrophobic membrane, sufficiently porous to allow gasses to pass through the membrane with little resistance;

said micro-porous hydrophobic membrane in the shape of a thin flat micro-porous sheet positioned over said top surface so that said reaction promoting catalyst is sandwiched between said micro-porous sheet and said non-porous substrate;

the outer margins of said micro-porous sheet are attached to outer margins of said top surface of said non-porous substrate by a sealing means, wherein the interface of said outer margins of said micro-porous sheet and said non-porous substrate are made substantially impervious to passage by gasses and liquid water.

11. The portable heat generating device according to claim 10, further including:

an electrically conducting path contiguous with said elongated substrate and of predetermined electrical resistance;

an electric current source means controlling the magnitude and time period of electric current in said electrically conducting path, whereby a joule heating effect occurs, providing a transient heat pulse to increase reactivity of said reaction promoting catalyst.

12. The portable heat generating device according to claim 10, further including:

an electrically conducting path contiguous with said elongated substrate with electrical properties that change measurably with temperature, said electrical properties selected from the group consisting of temperature coefficient of resistance and thermoelectric potential and semiconductor junction potential;

a temperature sensing means that correlates changes in the electrical properties of said electrically conducting path with the temperature change of said elongated substrate, whereby changes in said electrical properties are utilized to indicate that said elongated heat element is exceeding a predetermined temperature.

13. The portable heat generating device according to claim 10, wherein said micro-porous hydrophobic membrane is made of material selected from the group consisting of synthetic fluorinated polymers of substantial hydrophobic character and synthetic non-fluorinated polymers of substantial hydrophobic character.

14. A portable heat generating device, comprising:

(a) an envelope substantially constructed of polymeric materials, said materials selected from the group consisting of synthetic fluorinated polymers and synthetic non-fluorinated polymers, with an inlet and an outlet, having a plurality of internal channels for directing the flow of a gaseous fuel mixture to specific sites within said envelope, a plurality of said channels containing an elongated heat element;

(b) said elongated heat element comprising a reaction promoting catalyst that reacts with a gaseous fuel mixture to generate heat by flameless combustion, (c) a means for providing a substantially symmetric axial temperature profile of said elongated heat element over the length of said elongated heat element, whereby the power generated per linear axial unit distance, at each position along the heat element, is reduced for a given total power input to the heat element when compared to a non-symmetric axial temperature distribution with same said total power input;

(d) fuel source coupled to the inlet of said envelope; and (e) an oxygen source to admix with said fuel source forming said gaseous fuel mixture and transporting the fuel mixture to the inlet of said envelope where said fuel mixture reacts with said elongated heat element producing said gaseous combustion products that are expelled through the envelope outlet.

15. The portable heat generating device according to claim 14, wherein a means for providing a substantially symmetric axial temperature profile of said elongated heat element over the length of said elongated heat element, comprises:

an elongated, high thermal conductivity strip of material, at least the approximate length of the heat producing portion of said elongated heat element and in proximity with said elongated heat element, made largely of material selected from the group consisting of metal foil and metal film and metal wire and metal film-polymer laminates and metal links and metal filled polymers and metal oxides and metal oxide filled polymers, whereby the average axial thermal conductivity of said elongated heat element is increased substantially beyond the intrinsic thermal conductivity of the reaction promoting catalyst.

16. The portable heat generating device according to claim 14, wherein a means for providing a substantially symmetric axial temperature profile of said elongated heat element over the length of said elongated heat element, includes:

spatial modulation of the effective catalytic reactivity of said reaction promoting catalyst of said elongated heat element, said effective catalytic reactivity altered according to axial position along the length of the heat element, the alteration induced by surrounding said reaction promoting catalyst with a micro-porous membrane, the pores of said membrane selectively blocked by applying a non-porous coating to the surface of said membrane so as to impeded the movement of gases through said pores, such that the effective catalyst reactivity is less at the entry side of said gaseous fuel mixture and increases toward the exit side of said gaseous fuel mixture, whereby the symmetry of the axial temperature distribution along the length of said elongated heat element is substantially altered.

17. The portable heat generating device according to claim 14, wherein a means for providing a substantially symmetric axial temperature profile of said elongated heat element over the length of said elongated heat element, includes:

a predetermined cross sectional area of a channel containing said elongated heat element, such that the ratio $H_2/V$ is less than one, wherein $H_2$ is the equivalent chemical heat power, in units of watts, of the fuel mixture flow in said channel and V is the axial velocity of said fuel mixture flow, in units of centimeters per second, in said channel, whereby said ratio substantially effects the symmetry of the axial temperature distribution of said elongated heat element.

18. A method for generating heat in a portable heat generating device, the method comprising the steps of:

(a) transporting a fuel mixture into a plurality of channels, at least some said channels having an elongated heat element, said elongated heat element containing a reaction promoting catalyst which reacts with said fuel mixture to generate heat by flameless combustion;

(b) providing a fuel source coupled to the inlet of said envelope;

(c) providing an oxygen source to admix with said fuel source forming said gaseous fuel mixture and transporting the fuel mixture to the inlet of said envelope where said fuel mixture reacts with said elongated heat element producing said gaseous combustion products that are expelled through the envelope outlet.

(d) providing said channel, containing said elongated heat element, with a predetermined cross sectional area, such that the ratio $H_2/V$ is less than one, wherein $H_2$ is the equivalent chemical heat power, in units of watts, of the fuel mixture flow through said channel and V is the axial velocity of said fuel mixture flow through said channel, in units of centimeters per second, whereby said ratio substantially effects the symmetry of the axial temperature distribution of said elongated heat element.

19. The method according to claim 18, further comprising the step of:

spatially modulating the effective catalytic reactivity of said reaction promoting catalyst of said elongated heat element, said effective reactivity altered according to axial position along the length of the heat element, the alteration induced by surrounding said reaction promoting catalyst with a micro-porous membrane, the pores of said membrane selectively blocked by applying a non-porous coating to the surface of said membrane so as to impede the movement of gases through said pores, such that the effective catalyst reactivity is less at the entry side of said gaseous fuel mixture and increases toward the exit side of said gaseous fuel mixture, whereby the axial temperature distribution is altered along the length of said elongated heat element.

20. The method according to claim 18, further comprising the step of:

providing an elongated, high thermal conductivity strip of material, at least the approximate length of the heat producing portion of said elongated heat element and in proximity with said elongated heat element, made largely of material selected from the group consisting of metal foil and metal film and metal wire and metal film-polymer laminates and metal links and metal filled polymers and metal oxides and metal oxide filled polymers, whereby the average axial thermal conductivity of said elongated heat element is increased substantially beyond the intrinsic thermal conductivity of the reaction promoting catalyst.

* * * * *